US012668944B2

(12) United States Patent
Halike Gururaj et al.

(10) Patent No.: US 12,668,944 B2
(45) Date of Patent: Jun. 30, 2026

(54) LIP FOR USE ON A MATERIAL DISPLACEMENT APPARATUS

(71) Applicant: Hensley Industries, Inc., Dallas, TX (US)

(72) Inventors: Karthik Halike Gururaj, Bengaluru (IN); David M. Hymas, Addison, TX (US)

(73) Assignee: Hensley Industries, Inc., Dallas, TX (US)

( * ) Notice: Subject to any disclaimer, the term of this patent is extended or adjusted under 35 U.S.C. 154(b) by 454 days.

(21) Appl. No.: 18/298,963

(22) Filed: Apr. 11, 2023

(65) Prior Publication Data

US 2023/0323624 A1 Oct. 12, 2023

Related U.S. Application Data

(60) Provisional application No. 63/329,811, filed on Apr. 11, 2022.

(51) Int. Cl.
*E02F 3/40* (2006.01)
*E02F 9/28* (2006.01)

(52) U.S. Cl.
CPC ..... *E02F 3/401* (2013.01); *E02F 9/2825* (2013.01); *E02F 9/2883* (2013.01)

(58) Field of Classification Search
CPC ..... E02F 3/401; E02F 9/2825; E02F 9/2883; E02F 9/285; E02F 9/2858; E02F 9/2808; E02F 9/06; E02F 9/2816
See application file for complete search history.

(56) References Cited

U.S. PATENT DOCUMENTS 1,879,447 A 9/1932 Page
2,895,239 A 7/1959 Larsen
4,098,013 A 7/1978 Hemphill
(Continued)

FOREIGN PATENT DOCUMENTS

AU 2009201641 A1 7/2009
AU 2009201642 A1 7/2009
(Continued)

OTHER PUBLICATIONS

International Searching Authority, International Search Report and the Written Opinion of the International Searching Authority, International Application No. PCT/US23/18007, May 29, 2023, 11 pages, ISA/US.
(Continued)

*Primary Examiner* — Joseph M Rocca
*Assistant Examiner* — Robert E Pezzuto
(74) *Attorney, Agent, or Firm* — Haynes and Boone, LLP

(57) ABSTRACT

An excavating system for use in ground-engaging applications. The excavating system may include a wear member having a top leg, a bottom leg, and a bearing face connecting the legs. The excavating system may also include a lip, which may include a top inset surface. The top inset surface may have an upper bearing surface shaped to bear against an inner surface of the top leg of the shroud. The top inset surface may also have a forward bearing surface extending between the upper bearing surface and a lower surface formed on the downwardly facing surface. The forward bearing surface may face upwardly and forwardly at a non-vertical angle.

23 Claims, 6 Drawing Sheets

(56) References Cited

U.S. PATENT DOCUMENTS

| | | | | |
|---|---|---|---|---|
| 4,329,798 | A | 5/1982 | Edwards | |
| 4,414,764 | A | 11/1983 | Johansson | |
| 4,570,365 | A | 2/1986 | Bierwith | |
| 5,016,365 | A | 5/1991 | Robinson | |
| 5,084,990 | A | 2/1992 | Briscoe | |
| 5,088,214 | A | 2/1992 | Jones | |
| 5,575,092 | A | 11/1996 | Smit | |
| 5,680,717 | A | 10/1997 | Bierwith | |
| 5,713,145 | A | 2/1998 | Ruvang | |
| 5,832,638 | A | 11/1998 | Watts | |
| 5,901,480 | A | 5/1999 | Shamblin | |
| 6,070,345 | A | 6/2000 | Akaki | |
| 6,237,260 | B1 | 5/2001 | Gooch | |
| D478,599 | S | 8/2003 | Zaayman | |
| 6,751,897 | B2 | 6/2004 | Bierwith | |
| 6,834,449 | B2 | 12/2004 | Leslie | |
| 6,952,892 | B1 | 10/2005 | Bierwith | |
| 6,990,760 | B1 | 1/2006 | Zaayman | |
| 7,080,470 | B2 | 7/2006 | Jones | |
| 7,451,558 | B2 | 11/2008 | Jones | |
| 7,559,162 | B2 | 7/2009 | Bierwith | |
| 7,774,959 | B2 | 8/2010 | Kubo | |
| D631,490 | S | 1/2011 | Drager | |
| 8,024,874 | B2 * | 9/2011 | McClanahan | E02F 9/2883 37/446 |
| 8,250,785 | B2 | 8/2012 | Kubo | |
| D678,361 | S | 3/2013 | Attwood | |
| 8,572,870 | B2 | 11/2013 | Kudo | |
| 8,707,589 | B2 | 4/2014 | Hilton | |
| D705,275 | S | 5/2014 | Haslett | |
| 8,851,826 | B2 | 10/2014 | Nagata | |
| 8,959,806 | B2 | 2/2015 | Zamorano Jones | |
| 8,997,382 | B2 | 4/2015 | Gilmore | |
| 9,091,042 | B2 | 7/2015 | Guimaraes | |
| 9,096,992 | B2 | 8/2015 | Gilmore | |
| 9,180,558 | B2 | 11/2015 | Bienfang | |
| 9,428,881 | B1 | 8/2016 | Chabura | |
| D769,946 | S | 10/2016 | Kunz | |
| 9,499,959 | B2 | 11/2016 | Claudio | |
| 9,562,340 | B2 | 2/2017 | Yoshida | |
| 9,605,416 | B2 | 3/2017 | Campomanes | |
| D790,608 | S | 6/2017 | Kunz | |
| 9,670,643 | B2 | 6/2017 | Caux | |
| D797,162 | S | 9/2017 | Kunz | |
| 9,803,332 | B2 | 10/2017 | Tanaka | |
| 9,840,828 | B2 | 12/2017 | Bierwith | |
| 9,856,629 | B1 | 1/2018 | Kunz | |
| 9,903,092 | B2 | 2/2018 | Lunn | |
| 9,951,500 | B2 | 4/2018 | Kunz | |
| 9,957,696 | B2 | 5/2018 | Kunz | |
| 9,963,583 | B2 | 5/2018 | Chen | |
| 9,970,181 | B2 | 5/2018 | Kunz | |
| 9,988,795 | B2 | 6/2018 | Hooijmans | |
| 9,995,022 | B2 | 6/2018 | Hooijmans | |
| 10,100,498 | B2 | 10/2018 | Attwood | |
| 10,161,103 | B2 | 12/2018 | Falkenhagen | |
| 10,329,734 | B2 | 6/2019 | Garcia-Huidobro Valdivieso | |
| 10,371,669 | B2 | 8/2019 | Plouzek | |
| 10,378,178 | B2 | 8/2019 | Andritzky | |
| 10,422,103 | B2 | 9/2019 | Leslie | |
| 10,480,161 | B2 | 11/2019 | Serrurier | |
| 10,513,836 | B2 | 12/2019 | Leslie | |
| 10,519,621 | B2 | 12/2019 | Feld | |
| 10,590,633 | B2 | 3/2020 | Kunz | |
| 10,774,499 | B2 | 9/2020 | Ollinger, IV | |
| 2005/0241194 | A1 | 11/2005 | Bierwith | |
| 2010/0005689 | A1 | 1/2010 | Leslie | |
| 2010/0037493 | A1 | 2/2010 | Kim | |
| 2011/0094130 | A1 | 4/2011 | Hilton | |
| 2011/0167682 | A1 | 7/2011 | Leslie | |
| 2012/0036743 | A1 | 2/2012 | Mcclanahan | |
| 2012/0279095 | A1 | 11/2012 | Feld | |
| 2012/0304506 | A1 | 12/2012 | Guimaraes | |
| 2012/0304508 | A1 | 12/2012 | Guimaraes | |
| 2014/0305011 | A1 | 10/2014 | Leslie | |
| 2014/0360061 | A1 | 12/2014 | Kunz | |
| 2016/0237658 | A1 | 8/2016 | Ruvang | |
| 2017/0241109 | A1 | 8/2017 | De La Fuente | |
| 2019/0376263 | A1 | 12/2019 | Wood | |
| 2020/0048872 | A1 | 2/2020 | Serrurier | |
| 2020/0123732 | A1 | 4/2020 | Hall | |
| 2020/0157765 | A1 | 5/2020 | Sinn | |
| 2020/0157766 | A1 | 5/2020 | Feld | |
| 2020/0157776 | A1 | 5/2020 | Sinn | |
| 2020/0157777 | A1 | 5/2020 | Sinn | |
| 2020/0157778 | A1 | 5/2020 | Sinn | |
| 2020/0157779 | A1 | 5/2020 | Sinn | |
| 2020/0157780 | A1 | 5/2020 | Sinn | |
| 2020/0232193 | A1 | 7/2020 | Amat Holgado | |
| 2020/0308804 | A1 | 10/2020 | Churchill | |
| 2021/0238829 | A1 * | 8/2021 | Griffin | E02F 9/2816 |

FOREIGN PATENT DOCUMENTS

| | | | |
|---|---|---|---|
| AU | 2009203063 | B1 | 11/2009 |
| CN | 108026716 | A | 5/2018 |
| WO | 99/23316 | A1 | 5/1999 |
| WO | 2007016719 | A1 | 2/2007 |
| WO | 2011011825 | A1 | 2/2011 |
| WO | 2011150474 | A1 | 12/2011 |
| WO | 2015006809 | A1 | 1/2015 |
| WO | 2018170554 | A1 | 9/2018 |
| WO | 2020054639 | A1 | 3/2020 |
| WO | 2020054640 | A1 | 3/2020 |
| WO | 2020115295 | A1 | 6/2020 |
| WO | 2020115298 | A1 | 6/2020 |
| WO | 2020115300 | A1 | 6/2020 |
| WO | 2022/046796 | A1 | 3/2022 |

OTHER PUBLICATIONS

Search Report mailed Dec. 8, 2025 in related Eurasian patent application No. 202592388, original and translation, 6 pages.

Office Action mailed Feb. 25, 2026 in corresponding Chinese application No. 202380009245.8, original and English translation, 20 pages.

Extended European Search Report mailed May 6, 2026 in corresponding European application No. EP 23 78 8793, 7 pages.

* cited by examiner

LIP FOR USE ON A MATERIAL DISPLACEMENT APPARATUS

PRIORITY

This disclosure claims priority to and the benefit of the filing date of U.S. Provisional Patent Application No. 63/329,811, filed Apr. 11, 2022, titled Lip for Use on a Material Displacement Apparatus, incorporated herein by reference in its entirety.

TECHNICAL FIELD

This disclosure is generally directed to an improved lip design for use on a material displacement apparatus. The lip may be affixed to the end of a bucket and wear members (including shrouds, adapters, teeth, and wear caps) may be removably attached to the lip.

BACKGROUND

Material displacement apparatuses, such as excavating buckets found on construction, mining, and other earth moving equipment, often have lip assemblies affixed to the end of the bucket to improve their earth-engaging capabilities. The lip assembly includes a lip and replaceable wear members, which may include shrouds, adapters, teeth, and wear caps. The lip is affixed to the end of the bucket. The wear members can be removably attached to the end of the lip such that they come into abrasive, wearing contact with the earth or other material being displaced. Thus, the lip provides a base for the earth-engaging wear members, connecting them to the bucket. To improve functioning of the material displacement apparatus as a whole, the lip may be shaped to improve the operability and longevity of the wear members and the lip.

SUMMARY

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

An exemplary embodiment of the present disclosure may be an excavating system, which comprises a wear member and a lip. The wear member may have a leading end and a trailing end and include a receiving end having a top leg, a bottom leg, and a bearing face. The top leg and bottom leg may each have an inner surface. The lip of the present embodiment may have a leading end, a trailing end, an upwardly facing surface, and a downwardly facing surface. The lip may further include a top inset surface formed in the upwardly facing surface. The top inset surface may include an upper bearing surface, which is shaped to bear against the inner surface of the top leg. The top inset surface may also include a forward bearing surface extending between the upper bearing surface and a lower surface formed on the downwardly facing surface. The forward bearing surface may comprise a flat surface facing upwardly and forwardly at a non-vertical angle.

In some embodiments, the top inset surface may comprise side rims on opposing sides of the upper bearing surface and a back rim rearward of the upper bearing surface.

In some embodiments, the outer surface of the top leg of the wear member may have an elevation higher than the elevation of the top surface when the wear member is operably attached to the lip. However, in other embodiments, the outer surface of the top leg of the wear member may have an elevation lower than the elevation of the top surface when the wear member is operably attached to the lip.

In some embodiments, a portion of the upper bearing surface may be angled at a range of about 5 degrees to 30 degrees measured from a horizontal.

In other embodiments, the bearing face of the wear member may be angled at a non-vertical angle. In some embodiments, the bearing face is angled in a range of about 5 degrees to 30 degrees measured from a vertical.

In some embodiments, the upper bearing surface of the top inset surface comprises a front portion and a back portion, where the front portion is relatively flat and is angled upward from a horizontal. In particular embodiments, the front portion may be angled in a range of about 5 degrees to 30 degrees measured from a horizontal. In some embodiments, the back portion curves upward towards the back rim.

In some embodiments, the lip may also comprise a nose projecting from a leading end of the lip. Moreover, the lip may further comprise an intermediate surface disposed between a top surface and the nose. The intermediate surface may be sized and shaped to support a second wear member and may have an elevation lower than the top surface. The lip may also comprise a wear member protector projecting from the upwardly facing surface, where the wear member protector connects the intermediate surface and the top surface. The wear member protector may be disposed in a position to protect a trailing end of the second wear member from abrasive flow of materials being poured from a bucket.

In one implementation of the present disclosure, the embodiment may be an excavating system comprising an upwardly facing surface and a downwardly facing surface. The upwardly facing surface may span between two lateral sides and may have a top surface elevated with respect to other parts of the upwardly facing surface and a top inset surface that is sunken with respect to the top surface. The top inset surface may include an upper bearing surface shaped to bear against a top leg of a wear member and a forward bearing surface angled outward and shaped to bear against a bearing face of the wear member. The downwardly facing surface may span between the two lateral sides and may have a bottom surface elevated with respect to other parts of the downwardly facing surface.

In some embodiments, the forward bearing surface comprises a flat surface facing upwardly and forwardly at an angle in a range of about 5 degrees to 30 degrees measured from a vertical.

In some embodiments, the wear member supporting region of the top inset surface also includes an upper bearing surface with a front portion and a back portion. In some embodiments, the front portion is relatively flat and is angled from a horizontal and the back portion is curved. In particular embodiments, the front portion is angled in a range of about 5 degrees to 30 degrees measured from a horizontal.

An embodiment of the present disclosure may be a method of attaching a wear member to a lip as described herein. The method may include providing a lip having an upwardly facing surface spanning between two lateral sides.

The lip may comprise an upwardly facing surface. The upwardly facing surface may include a top surface elevated with respect to other parts of the upwardly facing surface and a top inset surface sunken with respect to the top surface. The top inset surface may have an upper bearing surface shaped to bear against an upper leg of a wear member and a forward bearing surface that is angled outward and shaped to bear against a bearing face of the wear member. The lip may also have a downwardly facing surface located opposite the upwardly facing surface. The downwardly facing surface may have a bottom surface elevated with respect to other parts of the downwardly facing surface. The method may also include locating a wear member about the forward bearing surface so that an upper leg of the wear member is disposed in the top inset surface.

In some embodiments, the method may also include the step of engaging the forward bearing surface with a surface of the wear member at the same angle as the forward bearing surface. In some embodiments, the angle is in the range of 5 degrees to 30 degrees measured from a vertical.

Some embodiments of the present disclosure may include an excavating system. The excavating system may include a wear member and a lip. The lip may include a nose, an upwardly facing surface, and a wear member protector. The upwardly facing surface may have a top surface and an intermediate surface disposed between the top surface and the nose. The intermediate surface may be sized and shaped to support the wear member and may be at an elevation lower than the top surface. The wear member protector may project from the upwardly facing surface and may have a lateral width at least as wide as the intermediate surface. The wear member protector may connect the intermediate surface and the top surface. The wear member protector may be shaped and positioned to protect a trailing end of the wear member from abrasive flow of materials being poured from a bucket.

In some embodiments, the intermediate surface and the top surface are substantially parallel.

In some embodiments, the mounting portion may have a top inset surface on each side of the nose, and the wear member protector may be disposed rearward of each top inset surface. In other embodiments, the wear member protector may be disposed only in a region behind the nose. In some embodiments, the intermediate surface may have two side surfaces extending therefrom.

In some embodiments, the wear member protector may have a front face facing a leading end of the lip and a back face facing a trailing end of the lip. In some embodiments, the front face is vertical and the back face curves downward to the top surface. The wear member protector may have a front height measured from a top of the wear member protector to the intermediate surface and a back height measured from the top of the wear member protector to the top surface. In some embodiments, the front height may be greater than the back height. In some embodiments, the wear member protector is a hook wear member protector and has a hole passing from a front face of the wear member protector to a back face of the wear member protector.

Some embodiments of the present disclosure include a lip for an excavating system. In some embodiments, the lip comprises a nose for supporting a ground engaging tool, an upwardly facing surface, and a wear member protector. The upwardly facing surface may include a top surface and an intermediate surface between the nose and the top surface. The intermediate surface may be shaped to fit a wear cap and may be at an elevation lower than the top surface. The wear member protector may be at an intersection of the intermediate surface and the top surface. A wear cap may be spaced from the wear member protector when it is affixed to the intermediate surface. Moreover, the wear member protector may be shaped and positioned to protect a trailing end of the wear cap from abrasive flow of materials being poured from a bucket.

In some embodiments, the wear member protector may project from the upwardly facing surface such that a top of the wear member protector is at a higher elevation than the top surface and the intermediate surface. In some embodiments, the wear member protector has a lateral width that is greater than a lateral width of the intermediate surface.

In some embodiments, the wear member protector has a front face facing a leading end of the lip and a back face facing a trailing end of the lip. In some embodiments, the front face is vertical and the back face curves downward to the top surface. The wear member protector may have a front height measured from a top of the wear member protector to the intermediate surface and a back height measured from the top of the wear member protector to the top surface. In some embodiments, the front height may be greater than the back height.

In some embodiments, the wear member protector may be a hook wear member protector, which has a hole passing from a front face of the wear member protector to a back face of the wear member protector.

Some embodiments of the present disclosure may include a lip for an excavating system. The lip may have a leading end, a trailing end, a nose, an upwardly facing surface, and a wear member protector. The nose may be disposed on the leading end and may support a ground engaging tool. The upwardly facing surface may be disposed between the leading end and the trailing end of the lip. The upwardly facing surface may include a top surface and an intermediate surface extending between the nose and the top surface. The intermediate surface may be shaped to fit a wear cap. The wear member protector may be disposed rearwardly of the intermediate surface. The wear member protector may have a height greater than a height of the wear cap when it is disposed over the intermediate surface. Moreover, the wear member protector may be shaped and positioned to protect a trailing end of the wear cap from abrasive flow of materials being poured from a bucket.

In some embodiments, the wear member protector may project upwardly from the upwardly facing surface. In some embodiments, the wear member protector may have a front face facing the leading end of the lip and forming an elevational step between the intermediate surface and the top surface. In some embodiments, the wear member protector may be integrally cast as a part of the lip.

Some embodiments of the present disclosure may include a method of attaching ground engaging tools to a lip for an excavating bucket. The method may include providing a lip according to the principles described herein. For example, the lip may include a nose, an upwardly facing surface and a wear member protector. The nose may be shaped to fit a ground engaging tool. The upwardly facing surface may have a top surface and an intermediate surface extending between the nose and the top surface. The intermediate surface may be disposed at a lower elevation than the top surface. The wear member protector may project from an intersection between the intermediate surface and the top surface. The method may also include attaching a wear member to the nose. The wear member may have a cavity shaped to fit over the nose. The method may also include attaching a wear cap to the intermediate surface such that the wear cap is adjacent to and in front of the wear member protector. The wear member protector may be positioned and shaped to protect a trailing end of the wear cap from abrasive flow of materials being poured from the excavating bucket.

In some embodiments, the wear member protector is integrally formed with the lip. In some embodiments, the wear member protector has a lateral width that is greater than a lateral width of the intermediate surface.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following.

BRIEF DESCRIPTION OF THE DRAWINGS

The accompanying drawings illustrate implementations of the systems, devices, and methods disclosed herein and together with the description, serve to explain the principles of the present disclosure.

Figure 1:
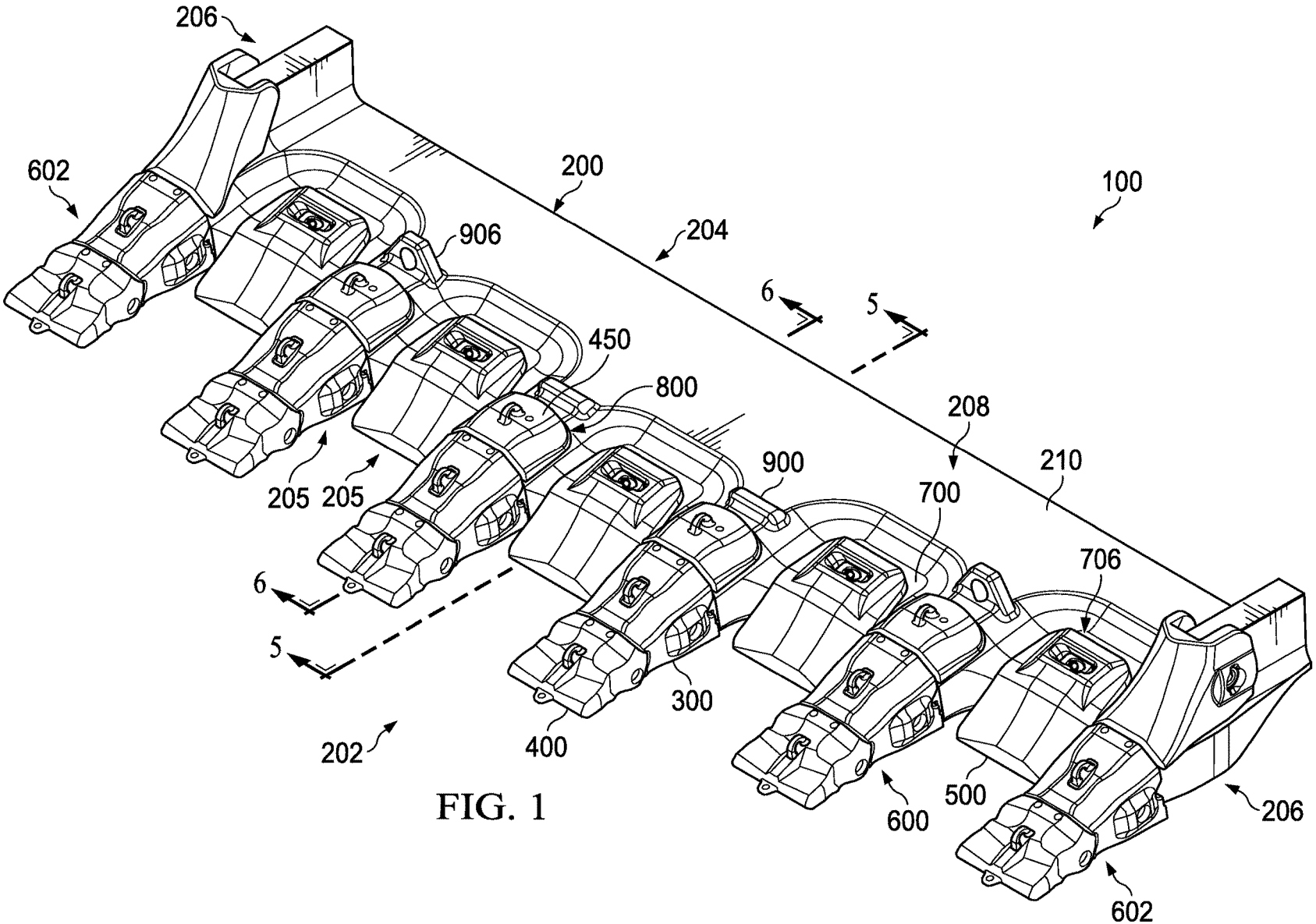
FIG. 1 is a perspective view of a lip assembly according to an example incorporating principles described herein.

These Figures will be better understood by reference to the following detailed description.

DETAILED DESCRIPTION

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an improved lip that may be attached to the bucket for various ground-engaging applications. In some examples, the lip is formed to provide protective shielding to portions of the wear members, even as the wear members provide protective shielding to the lip. In addition, the lip may provide an improved fit with wear members, while reducing weight of the lip. The lip may be cast or machined, or both. For example, the lip may have a wear member protector that is shaped to protect a wear cap from the abrasive flow of materials from the bucket, thus increasing the longevity of the wear cap. The lip may also be shaped to provide better contact with a shroud and protect the shroud, thus improving functioning of the shroud and increasing its longevity.

The lip may have a leading end and a trailing end, and an upwardly facing surface and a downwardly facing surface. The upwardly facing surface may include a top surface, an intermediate surface, and a top inset surface. The downwardly facing surface may include a bottom surface having a cross rib and back ribs, depressions between the ribs, and a bottom inset surface. Various ground engaging wear members can be mounted onto a mounting region on the leading end of the lip. The mounting region may include a plurality of noses to which wear members, including wear caps, adapters, and teeth, can be attached. The intermediate surface of the lip may extend between the base of the nose and the top surface of the lip. A wear member protector may be disposed at or formed on the lip at an intersection between the intermediate surface and the top surface in a manner that protects a wear cap from the abrasive flow of materials from the bucket. The mounting region also may include shroud supporting regions located on top inset surfaces of the lip. The shroud supporting regions on the top inset regions may be shaped to support and bear against a shroud.

FIG. 1 is a perspective view of a lip assembly 100 according to one embodiment of the present disclosure. The lip assembly 100 includes a lip 200, adapters 300, teeth 400, wear caps 450, and shrouds 500. The lip 200 has a leading end 202 and a trailing end 204 opposite the leading end 202. The lip also has two lateral sides 206. The top of the lip 200 contains an upwardly facing surface 208. The upwardly facing surface 208 comprises a top surface 210 that extends along the trailing end 204 of the lip between the sides 206, a top inset surface 700 (discussed in more detail below), and an intermediate surface 800 (discussed in more detail below). In this implementation, the sides 206 are disposed on lateral sides of the upwardly facing surface 208.

There is a mounting portion 205 on the leading end 202 of the lip 200. Various ground engaging tools can be mounted onto the mounting portion 205. The mounting portion 205 includes noses 600 (shown in FIG. 2) that project forward from the leading end 202. There can be side noses 602 that project from or are disposed in front of the sides 206. Ground engaging tools including adapters 300, teeth 400, and wear caps 450 can be affixed over the noses 600 and the intermediate surface 800. The mounting portion 205 also contains shroud supporting regions 706, which are formed on the top inset surfaces 700, and shroud supporting surfaces 1008 (not shown in FIG. 1), which is on the bottom inset surfaces 1000 (not shown in FIG. 1). The top inset regions 700 are located in between the noses 600, and the bottom inset regions 1000 are located on the lip generally opposite the top inset regions 700. A shroud 500 can be placed over and contact the shroud supporting regions 706, 1008. In this embodiment, there are six noses 600, which each fit one adapter 300 and one tooth 400. Moreover, there are five top inset surfaces 700 and shroud supporting regions 706 which each fit one shroud 500. However, in other embodiments, there can be more or fewer noses 600 and top inset surfaces 700. For example, in another embodiment, there may be four noses 600 and three top inset surfaces 700.

Figure 2:
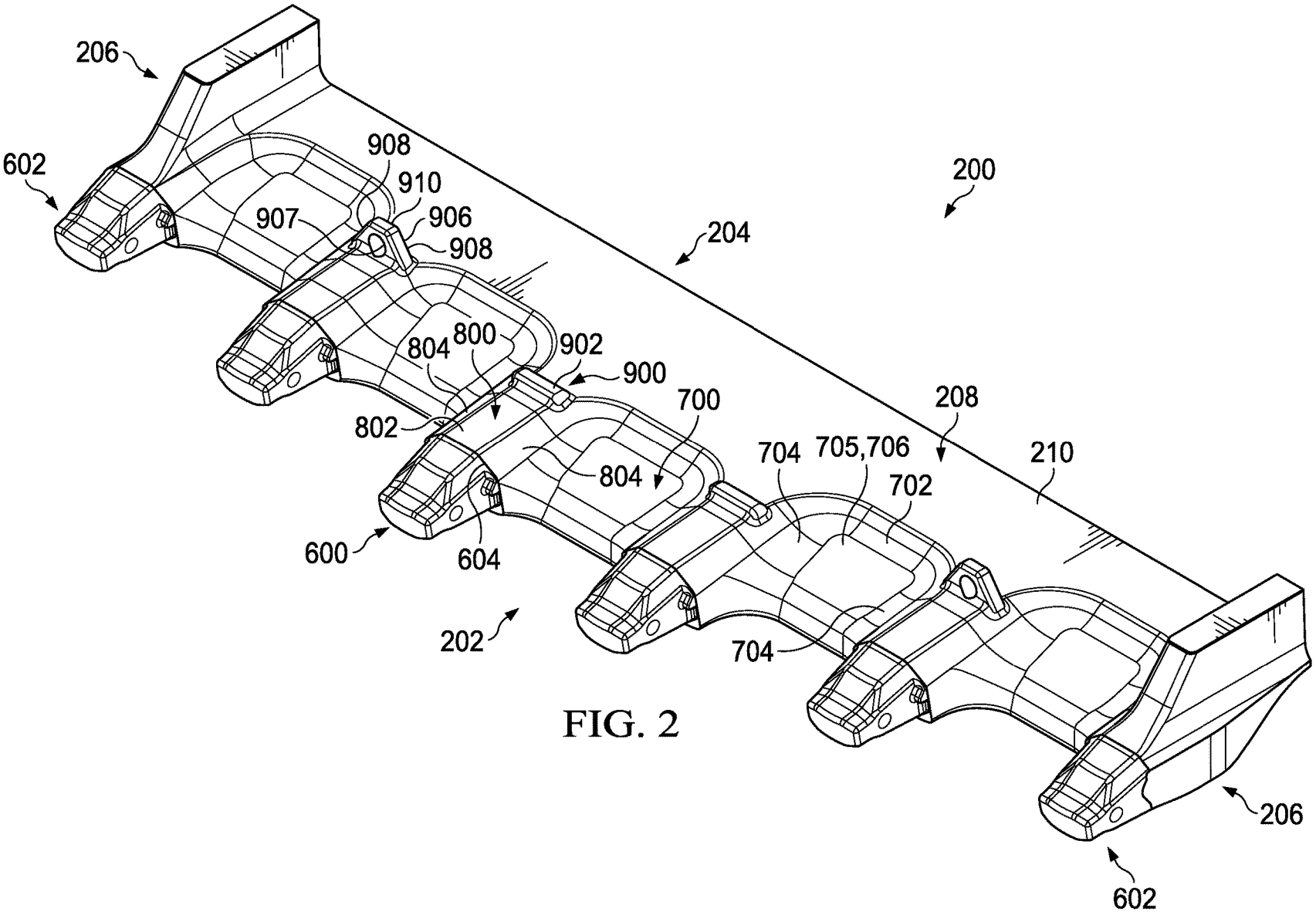
FIG. 2 is a perspective view of a lip according to an example incorporating principles described herein.
Figure 3:
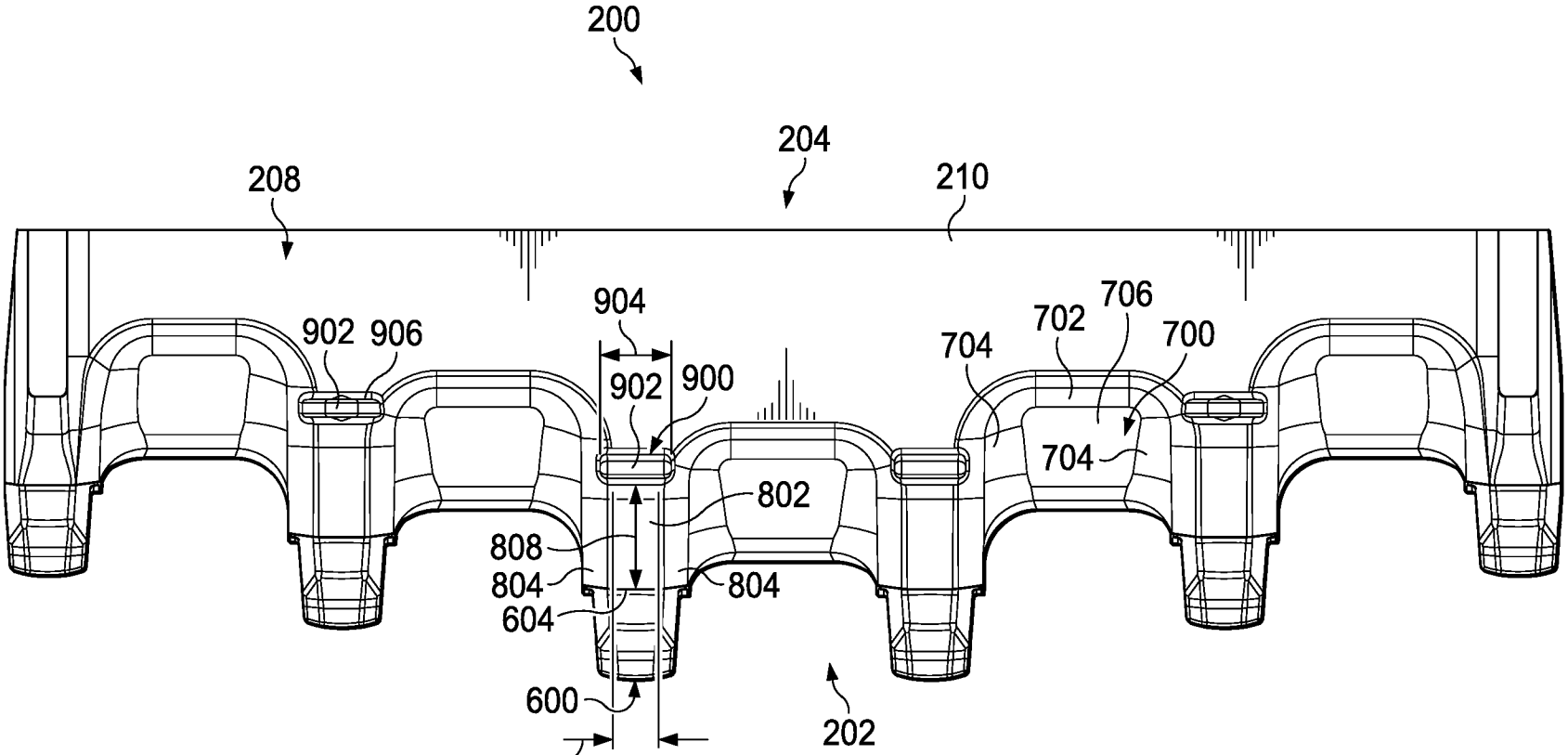
FIG. 3 is a top view of the lip according to an example incorporating principles described herein.

The top of the lip 200 can be seen in FIGS. 2 and 3. FIG. 2 is a perspective view of the lip 200. FIG. 3 is a top view of the lip 200. The intermediate surface 800 is disposed between a base 604 of the nose 600 and the top surface 210. The base 604 may be generally aligned with an end of the nose. In this embodiment, the intermediate surface 800 is at a lower elevation than the top surface 210. However, in other embodiments, the intermediate surface 800 and the top surface 210 may be at the same elevation. At the intersection between the intermediate surface 800 and the top surface 210, there is a wear member protector 900 that projects from the upwardly facing surface 208, so that the top 902 of the wear member protector 900 is at a higher elevation than both the top surface 210 and the intermediate surface 800. When a wear cap 450 is disposed over the intermediate surface 800, the trailing end 454 of the wear cap 450 is adjacent to, the wear member protector 900. In other embodiments, the wear cap 450 contacts the wear member protector 900 or nearly abuts against the wear member protector 900.

Although described as a projection from the upwardly facing surface, in some implementations, the wear member protector 900 extends upwardly from an end of the intermediate surface 800 to an elevation higher than both the top surface 210 and the intermediate surface 800. The wear member protector 900 may have a step downward to the top surface 210 of the lip 200. The step may be abrupt (e.g., a perpendicular step) or may be a gradual or incremented slope. Accordingly, the wear member protector 900 projects to an elevation above the top surface 210 of the lip 200.

The wear member protectors 900 may be integrally formed with the lip 200 or may be affixed to the lip 200. For example, the wear member protectors 900 may form a cast portion of a cast lip or may be welded or affixed to a portion of the lip. The wear member protector 900 is shaped to protect a trailing end of a wear cap 450 from the abrasive flow of materials when the materials are being dumped from the bucket to which the lip is attached. Thus, the wear member protector 900 increases the longevity of the wear cap 450. In other embodiments, the wear member protector 900 may also protect other ground engaging wear members like an adapter 300.

The intermediate surface 800 has a center 802 and two sides 804. The sides 804 slope downward from the center 802. The center 802 has a width 806. The wear member protector 900 is centered along the center 802 of the intermediate surface 800. In this embodiment, the wear member protector 900 has a larger width 904 than the width 806 of the center 802 of the intermediate surface 800. However, in other embodiments, the width 904 of wear member protector 900 can be equal to or shorter than the width 806 of the center 802 of the intermediate surface 800. Moreover, the intermediate surface 800 has a length 808 from the wear member protector 900 to the base 604 of the nose 600.

Some of the wear member protectors 900 are hook wear member protectors 906. The hook wear member protectors 906 may have a hole 907 passing through them. The hole 907 may receive a hook for lifting or carrying the lip, thereby providing dual purposes. The hook wear member protectors 906 have a greater height than the normal wear member protectors 900. In this embodiment, the sides 908 of the hook wear member protector 906 are angled towards the top 910 and the top 910 of the hook wear member protector 906 is flat. However, in other embodiments, the hook wear member protector 906 may be pointed at the top 910. In still other embodiments, the sides 908 of the hook wear member protector 906 may extend straight and have a flat top 910.

FIGS. 2 and 3 also show the top inset surfaces 700 of the upwardly facing surface 210 of the lip 200. The top inset surfaces 700 have a back rim 702, two side rims 704, and a shroud supporting region 706. The back rim 702 curves downward from the top surface 210. Each side rim 704 curves downward from the regions along the side of the top inset surface 700. From the back rim 702, the side rim 704 passes along the top surface 210, the wear member protector 900, and the intermediate surface 800 to the leading end 202 of the lip 200. The side rims 704 also curve down from the top surface 210, wear member protector 900, and intermediate surface 800. However, in other embodiments, the rims 702, 704 may not curve downward. For example, the rims 702, 704 may be flat or may be angled downward. Moreover, in some embodiments, the top inset surface 700 may not have any rims 702, 704, may only have a back rim 702, or may only have side rims 704.

A ridge 714 is formed between the top surface 210 and the rims 702, 704 of the top inset surface 700. Thus, the top inset surface 700 is sunken with respect to the surrounding surfaces and features (i.e. is at a lower elevation than the top surface 210, the intermediate surface 800, and the wear member protector 900). This allows the lip 200 to more easily penetrate the ground, improving functioning of the material displacing equipment. Moreover, because the top inset region 700 is sunken, the lip 200 has improved material flow between the ground and the bucket, improving functioning of the material displacing equipment. The top inset surface 700 includes a shroud supporting region 706 located between the back rim 702 and the side rims 704. A shroud 500 may fit over the shroud supporting region 706. Moreover, the top inset surface 700 curves or angles downward along the leading end 202 of the lip 200.

Figure 4:
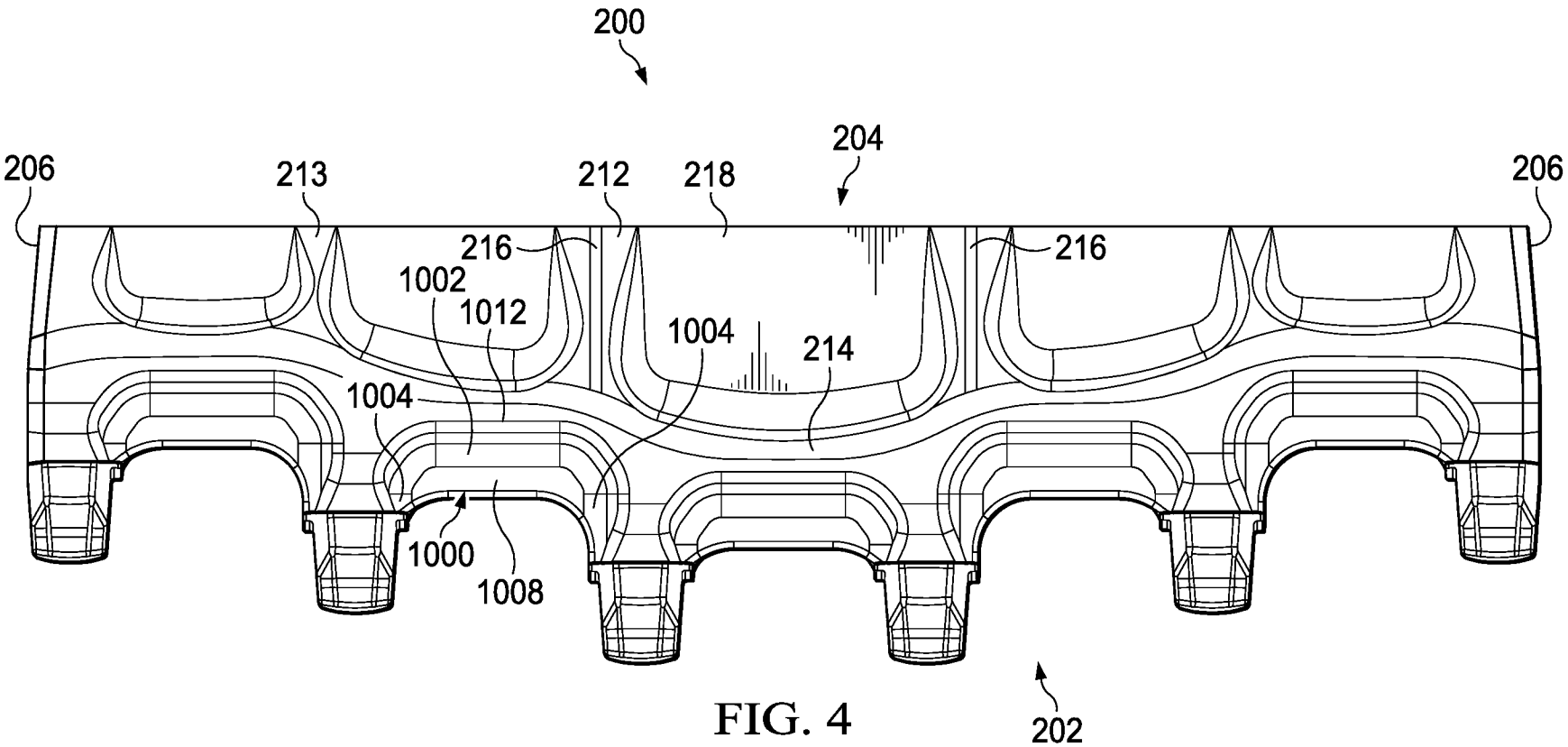
FIG. 4 is a bottom view of the lip according to an example incorporating principles described herein.

FIG. 4 is a bottom view of the lip 200. The lip 200 has a downwardly facing surface 212. The downwardly facing surface has a bottom surface 213, which includes a cross rib 214 that extends from one side 206 of the lip 200 to the other side 206. The bottom surface 213 also includes back ribs 216 that extend from the cross rib 214 to the trailing end 204 of the lip 200. There are depressions 218 along the trailing end 204 of the lip 200 between the back ribs 216 and the cross rib 214.

The cross rib 214 increases the stiffness of the lip 200. The back ribs 216 are offset from the noses 600. By having the back ribs 216 offset from the noses 600 instead of aligned with them, the back ribs 216 add stiffness to the lip 200. Because the cross rib 214 and the back ribs 216 stiffen the lip 200, the lip requires less material and thus can be a lighter weight than other lip designs.

The downwardly facing surface 212 also has a bottom inset surface 1000, which is disposed opposite the top inset surface 700. The bottom inset surface 1000 may be sunken with respect to the bottom surface such that the bottom surface 213 is at a lower elevation than the bottom inset surface 1000. Like the top inset surface 700, the bottom inset surface 1000 has a back rim 1002, two side rims 1004, and a shroud supporting region 1008. A shroud 500 may fit over the shroud supporting region 1008. In some embodiments, the shroud 500 may be disposed over the shroud supporting region 1008 on the bottom inset surface 1000, but in some implementations, the shroud may not be in continuous bearing engagement during use. Thus, the shroud 500 may have a top leg 502 that fits over the shroud supporting region 706 on the top inset surface 700 and a bottom leg 504 that fits over the shroud supporting region 1008 on the bottom inset surface 1000, as described in more detail below in reference to FIG. 5.

The back rim 1002 of the bottom inset surface 1000 curves upward from the bottom surface 213. The side rims 1004 run from the back rim 1002 towards the leading end 202 of the lip 200. The side rims 1004 curve upward from the bottom surface 213. Thus, there is a ridge 1012 formed along the intersection of the bottom surface 213 and the rims 1002, 1004 of the bottom inset region 1000. However, in some embodiments, the rims 1002, 1004 may not curve upward. For example, the rims 1002, 1004 may be flat or may be angled upward. In still other embodiments, the bottom inset surface 1000 may not have any rims 1002, 1004, may have only a back rim 1002, or may only have side rims 1004. The ridge 1012 prevents back drag on the ground engaging wear members.

Figure 5:
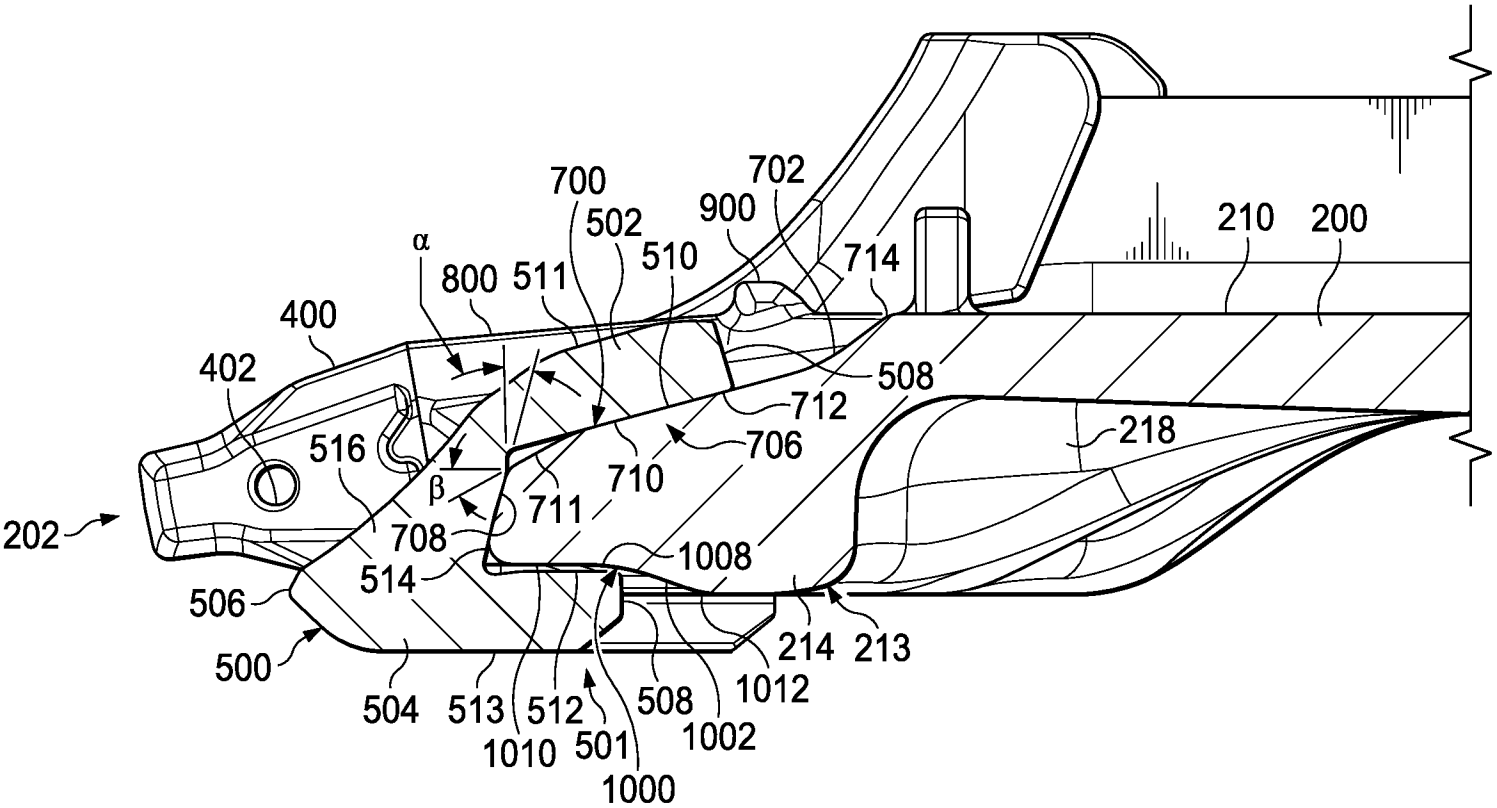
FIG. 5 is a cross-section of a shroud and inset region of a lip according to an example incorporating principles described herein.

FIG. 5 shows a cross section of the inset surfaces 700, 1000 and the shroud 500 of the lip assembly 100 shown in FIG. 1. Here, the shroud 500 is disposed over the shroud-supporting regions 706, 1008 of the inset surfaces 700, 1000.

The shroud-supporting region 706 of the top inset surface 700 has a forward bearing surface 708 along the leading end 202 of the lip 200 and an upper bearing surface 710. There is also a shroud supporting region 1008 on the bottom inset surface 1000, which includes a lower surface 1010. The forward bearing surface 708 is angled outward from a vertical as indicated by angle $\alpha$. In some embodiments, angle $\alpha$ can be any appropriate acute angle. For example, the angle $\alpha$ may be in the range of 5° to 30°. In a particular embodiment, for example, angle $\alpha$ is 15°. Because the forward bearing surface 708 is angled, there are reduced stresses in the shroud 500. Moreover, the angled forward bearing surface 708 supports the shroud 500 from standard digging forces by increasing the bearing surface area between the shroud 500 and the lip 200. The angle of the forward bearing surface 708 also stiffens the lip 200, improving functioning of the material displacement equipment.

In the present embodiment, the upper bearing surface 710 has a front portion 711 and a back portion 712. In some embodiments, the front portion 711 of the upper bearing surface 710 may be angled upward from a horizontal as indicated by angle $\beta$. In some embodiments, angle $\beta$ may be any appropriate acute angle. In a particular embodiment, for example, angle $\beta$ may be 15°. The back portion 712 of the upper bearing surface 710 may curve upward from the front portion 711 to the back rim 702. The back rim 702 may have a more pronounced curve than the back portion 712 of the upper bearing surface 710. There is a ridge 714 along the intersection between the top inset surface 700 and the top surface 210.

The shape of the upper bearing surface 710 reduces the force needed to penetrate the ground. Thus, less material is needed to form the lip 200 and the lip 200 may have a lower weight than other lip designs. Moreover, the shape of the top inset surface 700, including the rims 702, 704, reduce the length of the top leg 502 of the shroud 500.

The bottom inset surface 1000 of the downwardly facing surface 212 also has a shroud supporting region 1008 that contacts the shroud 500. The shroud supporting region 1008 includes the lower surface 1010 and generally extends horizontally from the leading end 202 of the lip 200. The back rim 1002 curves downward from the lower surface 1010 toward a ridge 1012. The ridge 1012 is located at the interface between the bottom inset surface 1000 and the cross rib 214 on the bottom surface 213. The cross rib 214 curves upward from the ridge 1012 of the bottom inset surface 1000 toward the depression 218.

In this embodiment, the cross rib 214 is generally located opposite the back rim 702 of the top inset surface 700. Therefore, the bottom inset surface 1000 has a smaller area than the top inset surface 700. However, in other embodiments, the cross rib 214 may be located closer to the leading end 202 of the lip 200. In still other embodiments, the cross rib 214 is located even with or behind the ridge 714 along the top inset surface 700.

The shroud 500 has a receiving portion 501 for receiving the shroud supporting regions 706, 1008. The receiving portion 501 comprises a top leg 502 and a bottom leg 504. The shroud 500 also has a leading end 506 and a trailing end 508. The top leg 502 has a top inner surface 510 that contacts the upper bearing surface 710 of the shroud supporting region 706. The top leg 502 also has a top outer surface 511. The bottom leg 504 has a bottom inner surface 512 that is disposed over the lower surface 1010 of the shroud supporting region 1008. However, in this embodiment, the bottom leg 504 does not bear loads against the lower surface 1010, although it may intermittently contact the lower surface during use as a result of loading or vibration. Instead, there may be a gap between the lower surface 1010 and the bottom leg 504. The bottom leg 504 also has a bottom outer surface 513. The shroud 500 also has a bearing face 516 that connects the top leg 502 and the bottom leg 504. The bearing face 516 has a front inner surface 514 that connects the top inner surface 510 of the top leg 502 and the bottom inner surface 512 of the bottom leg 504. The front inner surface 514 contacts the forward bearing surface 708 of the shroud supporting region 706. The inner surfaces 510, 514, and 512 of the shroud 500 generally follow the shape of the bearing surfaces 708, 710, and 1010, respectively, so that the inner surfaces 510 and 514 contact the respective bearing surfaces 708 and 710. Thus, the front inner surface 514 may have the same angle $\alpha$ as the forward bearing surface 708 of the shroud supporting region 706. Therefore, the front inner surface 514 may be angled in a range of 5° to 30° when measured from a vertical. In a particular embodiment, for example, the front inner surface 514 may be angled at 15° from the vertical.

When the shroud 500 is operably attached to the shroud supporting regions 706, 1008, the top leg 502 of the shroud 500 may not contact the back rim 702 of the top inset region 700. In some embodiments, elevation of the back rim 702 is higher than the outer surface 511 of the top leg 502 when it is disposed over the shroud supporting regions 706, 1008. In other embodiments, the back rim 702 of the top inset surface 700 may be at a lower elevation than the outer surface 511 of the top leg 502, but may be at a higher elevation than that of the top inner surface 510 of the top leg 502.

Moreover, in some embodiments, the bottom leg 504 of the shroud 500 may not contact the back rim 1002 of the bottom inset surface 1000. The back rim 1002 of the bottom inset surface 1000 may be at a higher elevation than the outer surface 513 of the bottom leg 504.

Additionally, FIG. 5 shows part of the adapter 300, tooth 400, intermediate surface 800, and wear member protector 900. The tooth 400 has a fastening feature 402 (as described in more detail below). In this embodiment, the fastening feature 402 is a hole that extends from one side of the tooth 400 to the other.

Figure 6:
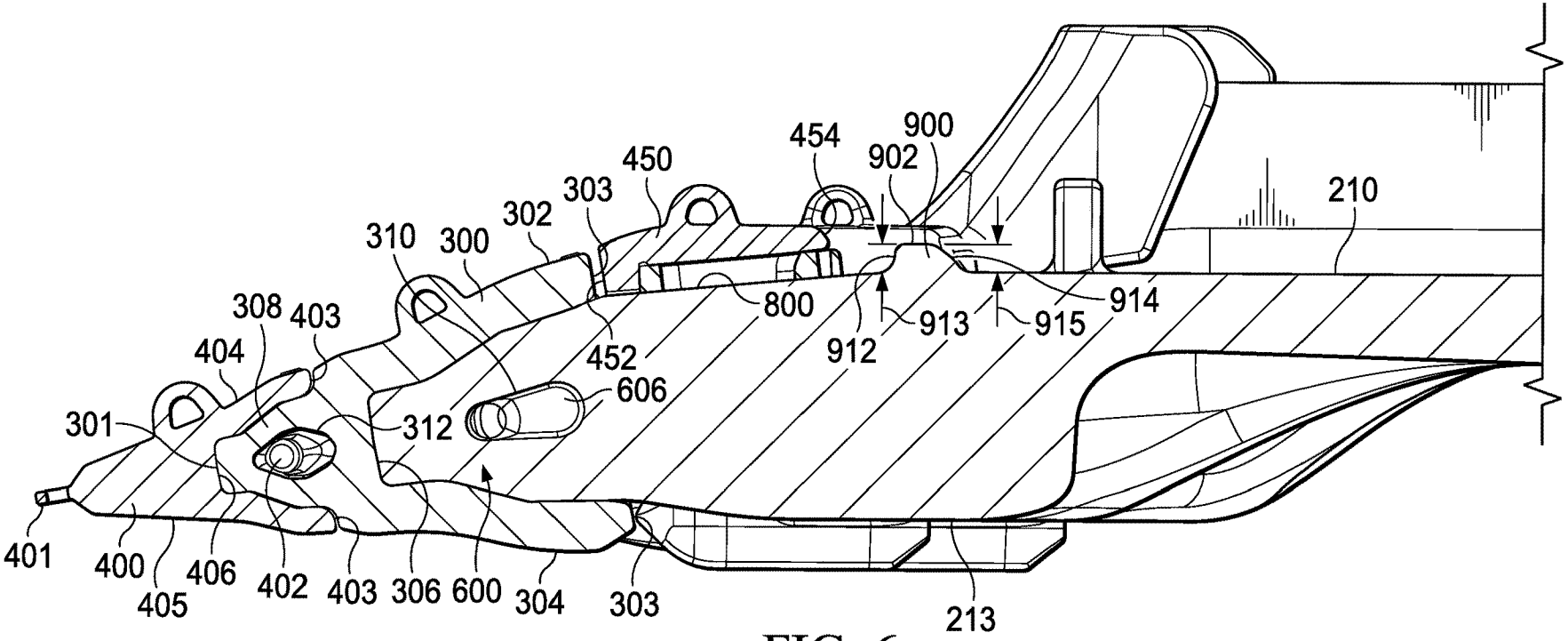
FIG. 6 is a cross-section of an adapter, tooth, and nose of a lip according to an example incorporating principles described herein.

FIG. 6 is a cross section of the nose 600, adapter 300, tooth 400, and wear cap 450 of the lip assembly 100 in FIG. 1. The adapter 300 has a leading end 301 and a trailing end 303. The adapter 300 has a top half 302 and a bottom half 304 that define a cavity 306 along its trailing end 303. The cavity 306 is shaped to fit over or receive the nose 600 of the lip 200. The adapter 300 also has a nose 308 on its leading end 301.

The nose 600 of the lip 200 has a fastening feature 606. In this embodiment, the fastening feature 606 is a hole that passes from one side of the nose 600 to the other. The adapter 300 also has a back fastening feature 310 that passes through the cavity 306. In this embodiment, the back fastening feature 310 is a hole that passes from one side of the adapter 300 to the other. When the adapter 300 is disposed over the nose 600, the back fastening feature 310 of the adapter 300 aligns with the fastening feature 606 of the nose 600.

The tooth 400 has a leading end 401 and a trailing end 403. Similar to the adapter 300, the tooth 400 has a top half 404 and a bottom half 405 that define a cavity 406 along its trailing end 403. The cavity 406 is shaped to fit over or receive the nose 308 of the adapter 300.

The adapter 300 also has a front fastening feature 312 that passes through the nose 308. In this embodiment, the front fastening feature 312 is a hole that passes from one side of the adapter to the other. Moreover, the tooth 400 has a fastening feature 402. In this embodiment, the fastening feature 402 is a hole that passes from one side of the tooth 400 to the other. When the tooth 400 is disposed over the nose 308 of the adapter 300, the fastening feature 402 of the tooth 400 aligns with the front fastening feature 312 of the adapter 300.

The wear cap 450 is disposed over the intermediate surface 800. The wear cap 450 has a leading end 452 that contacts top half 302 of the adapter 300 along the trailing end 303. The trailing end 454 of the wear cap 450 extends towards the wear member protector 900. In this embodiment, the wear cap 450 does not contact the front face 912 of the wear member protector 900. However, in other embodiments, the wear cap 450 may contact the wear member protector 900.

The wear member protector 900 has a front face 912 and a back face 914. The front face 912 is generally vertical. The back face 914 slopes downward towards the top surface 210 of the lip 200. The wear member protector 900 has a front height 913 from the intermediate surface 800 to the top 902 of the wear member protector 900. The wear member protector 900 also has a back height 915 from the top surface 210 of the lip 200 to the top 902 of the wear member protector 900. In this embodiment, because the intermediate surface 800 is at a lower elevation than the top surface 210, the front height 913 is larger than the back height 915 of the wear member protector 900. However, in other embodiments, the intermediate surface 800 and the top surface 210 may be at the same elevation. In these embodiments, the front height 913 and back height 915 would be the same.

According to some implementations, methods of using the lip may include methods of attaching a wear member to a lip. The methods may include providing a lip according to an embodiment described herein. For example, the lip may have an upwardly facing surface spanning between two lateral sides. The upwardly facing surface may have a top surface, which is elevated with respect to other parts of the upwardly facing surface, and a top inset surface, which is sunken with respect to the top surface and curves down from the top surface. The top inset surface of the lip may have a wear member supporting region shaped to bear against an upper leg of a wear member, which includes a forward bearing surface angled outward and shaped to bear against a bearing face of the wear member. The lip may also have a downwardly facing surface opposing the upwardly facing surface, which has a bottom surface, which is elevated downward with respect to other parts of the downwardly facing surface, and a bottom inset surface, which is sunken with respect to the bottom surface and curves upward from the bottom surface. The method may also include putting a wear member onto the lip such that the wear member contacts the wear member supporting region on the top surface. Therefore, an upper leg of the wear member would fit over the top inset surface and a lower leg of the wear member would fit over the bottom inset surface. In some embodiments, the lower leg may not be bear loads against the bottom inset surface. Instead, there may be a gap between the lower leg and the bottom inset surface when unloaded.

Additionally, the methods of using the lip may include methods of attaching ground engaging tools to a lip for use in an excavating bucket. The method may include providing a lip according to an embodiment described herein. For example, the lip may include a nose shaped to fit a ground engaging tool and an upwardly facing surface. The upwardly facing surface may have a top surface which extends along the trailing end of the lip and an intermediate surface extending between the nose and the top surface such that the intermediate surface is at a lower elevation than the top surface. The lip may also include a wear member protector that projects from an intersection between the intermediate surface and the top surface. The method may also include attaching a wear member to the nose. The wear member may have a cavity on a trailing end that is shaped to fit the nose. Therefore, the cavity of the wear member can be disposed over the nose. The method may also include attaching a wear cap to the intermediate surface such that the wear cap is adjacent to and in front of the wear member protector. The wear member protector may be positioned and shaped to protect a trailing end of the wear cap from abrasive flow of materials being poured from the excavating bucket.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. An excavating system, comprising:

a wear member having a leading end and a trailing end, the wear member comprising a receiving end having a top leg having an inner surface, a bottom leg having an inner surface, and a bearing face connecting the top leg and the bottom leg; and a lip having a leading end, a trailing end, an upwardly facing surface, and a downwardly facing surface, the lip comprising:

a top inset surface formed in the upwardly facing surface, the top inset surface having:

an upper bearing surface shaped to bear against the inner surface of the top leg; and a forward flat bearing surface extending between the upper bearing surface and a lower surface formed on the downwardly facing surface and shaped to bear against the bearing face of the wear member, the forward flat bearing surface facing upwardly and forwardly at a non-vertical angle.

2. The excavating system of claim 1, wherein the top inset surface comprises side rims on opposing sides of the upper bearing surface and a back rim rearward of the upper bearing surface.

3. The excavating system of claim 1, wherein the lip further comprises a top surface extending between the trailing end and the top inset surface, and wherein an outer surface of the top leg of the wear member has an elevation higher than the elevation of the top surface when the wear member is operably attached to the lip.

4. The excavating system of claim 1, wherein the lip further comprises a top surface extending between the trailing end and the top inset surface, and wherein an outer surface of the top leg of the wear member has an elevation lower than the elevation of the top surface when the wear member is operably attached to the lip.

5. The excavating system of claim 1, wherein the forward flat bearing surface is angled in a range of about 5 degrees to 30 degrees measured from a vertical.

6. The excavating system of claim 1, wherein a portion of the upper bearing surface is angled in a range of about 5 degrees to 30 degrees measured from a horizontal.

7. The excavating system of claim 1, wherein the bearing face of the wear member is angled at a non-vertical angle.

8. The excavating system of claim 6, wherein the bearing face is angled in a range of about 5 degrees to 30 degrees measured from a vertical.

9. The excavating system of claim 1, wherein the upper bearing surface of the top inset surface comprises a front portion and a back portion, the front portion being relatively flat and angled upward from a horizontal.

10. The excavating system of claim 9, wherein the front portion is angled in a range of about 5 degrees to 30 degrees measured from a horizontal.

11. The excavating system of claim 9, wherein the back portion curves upward.

12. An excavating system, comprising:

a wear member having a leading end and a trailing end, the wear member comprising a receiving end having a top leg having an inner surface, a bottom leg having an inner surface, and a bearing face connecting the top leg and the bottom leg; and a lip having a leading end, a trailing end, an upwardly facing surface, and a downwardly facing surface, the lip comprising:

a top inset surface formed in the upwardly facing surface, the top inset surface having:

an upper bearing surface shaped to bear against the inner surface of the top leg; and a forward flat bearing surface extending between the upper bearing surface and a lower surface formed on the downwardly facing surface, the forward flat bearing surface facing upwardly and forwardly at a non-vertical angle;

a top surface extending between the trailing end and the top inset surface;

a nose projecting from a leading end of the lip;

an intermediate surface disposed between the top surface and the nose, the intermediate surface sized and shaped to support a second wear member and having an elevation lower than the top surface; and, a wear member protector projecting from the upwardly facing surface, the wear member protector connecting the intermediate surface and the top surface, the wear member protector being disposed in a position to protect a trailing end of the second wear member from abrasive flow of materials being poured from a bucket.

13. An excavating system, comprising:

an upwardly facing surface spanning between two lateral sides, the upwardly facing surface having:

a top surface elevated with respect to other parts of the upwardly facing surface, and;

a top inset surface sunken with respect to the top surface, the top inset surface having:

a forward flat bearing surface angled outward at a non-vertical angle and shaped to bear against a bearing face of a wear member; and, an upper bearing surface shaped to bear against a top leg of the wear member;

a downwardly facing surface spanning between the two lateral sides, the downwardly facing surface having:

a bottom surface elevated with respect to other parts of the downwardly facing surface.

14. The excavating system of claim 13, wherein the non-vertical angle is in a range of about 5 degrees to 30 degrees measured from a vertical such that the forward flat bearing surface faces upwardly and forwardly.

15. The excavating system of claim 13, wherein the upper bearing surface comprises a front portion and a back portion.

16. The excavating system of claim 15, wherein the front portion is relatively flat and is angled from a horizontal and the back portion is curved.

17. The excavating system of claim 16, wherein the front portion is angled in a range of about 5 degrees to 30 degrees measured from a horizontal.

18. A method of attaching a wear member to a lip, comprising:

providing the lip, the lip comprising:

an upwardly facing surface spanning between two lateral sides and having:

a top surface elevated with respect to other parts of the upwardly facing surface, and a top inset surface sunken with respect to the top surface, the top inset surface having:

an upper bearing surface shaped to bear against a top leg of the wear member; and, a forward flat bearing surface angled at a non-vertical angle outward and shaped to bear against a bearing face of the wear member; and, a downwardly facing surface opposing the upwardly facing surface, the downwardly facing surface having a bottom surface elevated with respect to other parts of the downwardly facing surface; and locating the wear member about the forward flat bearing surface so that the top leg of the wear member is disposed in the top inset surface.

19. The method of claim 18, comprising engaging the forward flat bearing surface with a surface of the wear member at a same angle as the forward flat bearing surface.

20. The method of claim 19, wherein the angle is in the range of 5 degrees to 30 degrees measured from a vertical.

21. An excavating system, comprising:

a lip for supporting a wear member, comprising:

a nose projecting from a leading end of the lip;

an upwardly facing surface, comprising:

a top surface;

an intermediate surface disposed between the top surface and the nose, the intermediate surface sized and shaped to support the wear member and having an elevation lower than the top surface; and a wear member protector projecting from the upwardly facing surface, the wear member protector connecting the intermediate surface and the top surface, the wear member protector being shaped and positioned to protect a trailing end of the wear member from abrasive flow of materials being poured from a bucket.

22. The lip of claim 21, wherein the lip further comprises a top inset surface on each side of the nose, the wear member protector being disposed rearward of each top inset surface.

23. The lip of claim 21, wherein the wear member protector projects from the upwardly facing surface in a manner that a top of the wear member protector is at a higher elevation than the top surface and the intermediate surface.

* * * * *